United States Patent [19]

Hawkins et al.

[11] Patent Number: 4,992,347

[45] Date of Patent: Feb. 12, 1991

[54] MARKING

[75] Inventors: Michael Hawkins, Coventry; Arthur G. Bowyer, Derby, both of United Kingdom

[73] Assignee: Courtaulds PLC, United Kingdom

[21] Appl. No.: 500,108

[22] PCT Filed: Feb. 12, 1988

[86] PCT No.: PCT/GB88/00088

§ 371 Date: Sep. 26, 1988

§ 102(e) Date: Sep. 26, 1988

[87] PCT Pub. No.: WO88/06306

PCT Pub. Date: Aug. 25, 1988

Related U.S. Application Data

[63] Continuation of Ser. No. 252,361, Sep. 26, 1988.

[30] Foreign Application Priority Data

Feb. 13, 1987 [GB] United Kingdom ..... 8703400

[51] Int. Cl.[5] ..... G03C 3/00

[52] U.S. Cl. ..... 430/10; 430/17; 430/19; 430/345; 430/962

[58] Field of Search ..... 430/338, 336, 345, 396, 430/495, 962, 19, 17, 10

[56] References Cited

U.S. PATENT DOCUMENTS 4,220,708 9/1980 Heller ..... 430/19

FOREIGN PATENT DOCUMENTS 2192006A 12/1987 United Kingdom .

OTHER PUBLICATIONS

Glaze et al, J. Chem. Soc. Perkin Trans. I, 957–961 (1985).

A. E. J. Wilson, Molecular Electronics 1, Phys. Technol., 15:232–238 (1984).

*Primary Examiner*—Paul R. Michl

*Assistant Examiner*—Thorl Chea

*Attorney, Agent, or Firm*—Howson and Howson

[57] ABSTRACT

A marking comprises a layer, preferably of film-forming material, which contains a photochromic compound. The photochromic compound is capable of changing color when exposed to uv light, but can be converted to a permanently non-photochromic compound, preferably by overexposure to uv light. An image is formed in the layer by converting the photochromic compound to a permanently non-photochromic compound in one or more selected areas. When the layer is subsequently viewed under uv light a colorless image of non-photochromic compound can be seen on a background of colored photochromic compound.

13 Claims, 1 Drawing Sheet

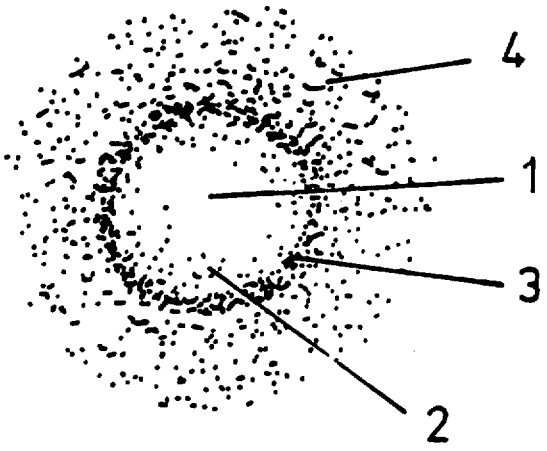
4
1
3
2

MARKING

This is a continuation of co-pending application Ser. No. 07/252,361 filed on Sept. 26, 1988 now abandoned.

This invention relates to the marking of items such as goods, packages, documents or identification cards, for example to provide security markings, using photochromic compounds.

A photochromic compound is a compound that undergoes a colour change when irradiated with light of a certain wavelength, which colour change may be reversible or irreversible. In general the compounds are coloured when irradiated with uv light and convert to a pale or colourless form in visible light. Examples of reversible photochromic compounds are spiropyrans and fulgides, the latter being described in UK Patent Nos. 1 442 628 and 1 464 603, and in published UK Patent Application No. 2 170 202A. Films containing a reversible photochromic compound have been suggested for the temporary recording of information, for example by a laser of visible light which converts the photochromic compound to its pale or colourless state, creating a recorded image which can be stored in the dark and erased by uv. Such a system is suggested by H. G. Heller in IEE Proceedings, Volume 130, part 1, no. 5, October 1983, and in British Patent No. 1 600 615.

Photochromic compounds, particularly those which are colourless under white light, can be used for marking. The marking can be illuminated by uv light and an image previously invisible under white light can be observed. A photochromic image can, for example, be printed on a substrate using an ink containing the photochromic compound. Security marking applied as an ink has disadvantages in that the presence of ink markings can usually be detected even if the ink is colourless and forging of the markings is possible by anyone having access to the photochromic ink. The present invention relates to more secure marking using photochromic compounds.

Accordingly the present invention provides a marking comprising a photochromic layer which contains or consists of a photochromic compound, which layer has an image formed therein by complete or partial conversion of the photochromic compound to a permanently non-photochromic compound in one or more selected areas. The invention also includes articles and materials having such a marking and a process for producing such a marking by forming the image in the layer.

The preferred method of conversion of the photochromic compound to a permanently non-photochromic compound (hereinafter referred to as degradation) is by over-exposure to uv light. The published literature on photochromics emphasises their reversibility but we have found surprisingly that over-exposure to uv light can completely degrade some photochromic compounds to a relatively colourless non-photochromic form. This non-photochromic form undergoes substantially no colour change under uv or visible light and cannot readily be distinguished by the eye against a background of the pale or colourless form of the photochromic compound under visible light, but after irradiation with uv light it is readily distinguished against a background of the more coloured form of the photochromic compound.

Advantageously the photochromic compound is reversible, preferably converting from pale or colourless to coloured under uv light and reverting to pale or colourless under visible light. Photochromic compounds which are irreversible or substantially irreversible can, however, be used for applications where the image is only to be viewed once or where it is not necessary that the image, once viewed, will revert to its invisible form. In general, it is preferred to employ photochromic compounds that are thermally stable in their coloured state, although photochromic compounds that thermally revert to their pale or colourless state may be used if desired. The thermal reversion may occur at room temperature or below but, where a thermally reversible photochromic compound is used, the compound is preferably stable at room temperature for long enough for the image to be clearly seen but is preferably also capable of relatively fast reversion to its pale or colourless state at a more elevated temperature, for example from 40° to 80° C. Examples of thermally unstable photochromic compounds are some spiropyran compounds and some 1,2-dihydro-9-xanthenone compounds.

The preferred photochromic compounds are fulgides, as described for example in UK Patent Nos. 1 442 628 and 1 464 603 and published UK Patent Application No. 2 170 202A. The photochromic fulgides generally have the formula

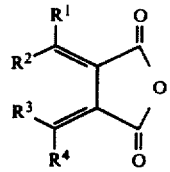

(I)

in which at least one of the substituents $R^1$, $R^2$, $R^3$ and $R^4$ is an aromatic group (which term includes heterocyclic aromatic groups), the other substituents being hydrogen or monovalent hydrocarbon groups, which can be substituted, provided that at least one of $R^1$ and $R^2$ and at least one of $R^3$ and $R^4$ is other than hydrogen. Preferably all the substituents are other than hydrogen. Examples of preferred photochromic fulgides are those of formula (I) in which $R^1$, $R^3$ and $R^4$ are all $CH_3$ and $R^2$ is an alkyl-substituted 3-furyl or 3-thienyl or 3-pyrryl group, particularly alpha-2,5-dimethyl-3-furylethylidene (isopropylidene) succinic anhydride, alpha-2,5-dimethyl-3-thienylethylidene (isopropylidene) succinic anhydride and alpha-1,2,5-trimwthyl-3-pyrrylethylidene (isopropylidene) succinic anhydride and also alpha-2-benzyl-3-benzofurylethylidene (isopropylidene) succinic anhydride, alpha-2,5-dimethyl-3-furylethylidene (piperonylidene) succinic anhydride, alpha-2,5-dimethyl-3-furylethylidene (diphenylmethylene) succinic anhydride, alpha-2,5-dimethyl-3-furylethylidene (2-butenylidene) succinic anhydride, alpha-2,5-dimethyl-1-phenyl-3-pyrrylethylidene (isopropylidene) succinic anhydride, alpha-2,5-dimethyl-1-p-tolyl-3-pyrrylethylidene (isopropylidene) succinic anhydride, alpha-1,5-diphenyl-2-methyl-3-pyrrylethylidene (isopropylidene) succinic anhydride and alpha-2,5-dimethyl-1-phenyl-3-pyrrylethylidene (dicyclopropylmethylene) succinic anhydride. Fulgides containing a methoxy-substituted phenyl group can also be used, for example 3,5-dimethoxybenzylidene (isopropylidene) succinic anhydride and 3,4,5-trimethoxybenzylidene (isopropylidene) succinic anhydride. The fulgides derive their photochromic characteristics from their ability to undergo reversible ring closure. For example, where $R^2$ is the aromatic group, ring closure occurs between $R^2$ and the carbon atom to which $R^3$ and $R^4$ are attached. We have found that the photochromic fulgides of the above formula (I) we have tested are converted through the coloured form to b permanently non-photochromic form by over exposure to uv light. The corresponding fulgimides (II) and N-aminofulgimides (III) of the formulae

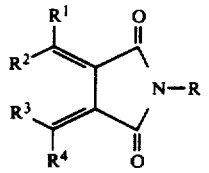

(II)

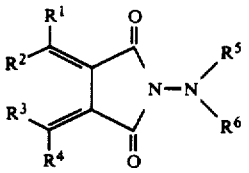

(III)

where $R^1$, $R^2$, $R^3$ and $R^4$ have the above meanings and R, $R^5$ and $R^6$ are each hydrogen or an aryl or alkyl group, which can be substituted, are also generally photochromic compounds and can be used in the invention. Some fulgimides are described in UK Patent Nos. 1 442 628 and 1 464 603, for example alpha-2,5-dimethyl-3-thienylethylidene (isopropylidene) N-phenylsuccinimide or 3,5-dimethoxybenzylidene (isopropylidene) N-phenyl succinimide. Some N-aminofulgimides are described in a paper entitled 'Uber die Photochromie der Fulgide' by M. Reichenbacher, H. Ilge and R. Paetzold, Z. Chem., 20Jg (1980) Heft 5, pp 188-189. Other photochromic compounds, for example spiropyrans or 1,2-dihydro-9-xanthenones, can alternatively be used. A mixture of two or more photochromic compounds may be used, although usually the layer contains or consists of a single photochromic compound.

The marking according to the invention preferably comprises a layer of film-forming material containing a photochromic compound, the film-forming material being substantially transparent to uv and visible light at the wavelengths that activate the photochromic compound. The photochromic compound is preferably incorporated in the film-forming material by dissolving or dispersing it in a solution of a film-forming polymer transparent to uv light of wavelength above 300 nm. The most preferred film-forming polymer is cellulose acetate. Alternatives are other cellulose esters, polyesters, for example polyethylene terephthalate, acrylic polymers, for example polymethyl methacrylate, polyurethanes, olefin polymers, for example polyethylene or polypropylene or ethylene vinyl acetate copolymers, vinyl polymers, for example polyvinyl acetate or polyvinyl chloride, polycarbonates and polyamides. The photochromic compound is preferably dissolved in the solution so that it is more uniformly dispersed in the film formed. The photochromic fulgides for instance are soluble in a wide range of organic solvents, for example ketones such as acetone or methylethyl ketone, esters such as ethyl acetate, aromatic hydrocarbons such as toluene, chlorinated hydrocarbons such as chloroform or methylene chloride, or ethers. They are not very soluble in water or aliphatic hydrocarbons and are reactive to some extent with lower alcohols such as methanol and ethanol. The solution can be cast or coated on a substrate to form a film. The photochromic fulgides for example can readily be incorporated in cellulose acetate film cast from acetone solution. The concentration of the photochromic compound is generally 0.03 to 10% by weight based on the film-forming material, preferably 0.1 to 5%, and most preferably 0.2 to 2%. The film is preferably colourless apart from the photochromic compound but alternatively can be lightly pigmented or dyed with a pigment or dye which is not degraded in uv light.

The solution of the film-forming material and photochromic compound can be formed into a continuous layer by casting as a film or coating on a substrate as described above or can be printed on a substrate to form relatively broad markings. In the latter case the printed photochromic layer can be degraded in selected areas to form an image which is not visible in white light but is seen as superimposed on the printed areas when viewed after being irradiated with uv light.

When the film-forming material is a melt extruded polymer, for example polyethylene, polypropylene or copolymers thereof, or ethylene-vinyl acetate copolymer, the photochromic compound can be dispersed in the polymer melt prior to extrusion, but care must be taken not to thermally damage the photochromic compound during extrusion. Useful photochromic compounds in this instance, generally are stable to temperatures up to 100° C. or even 180° C.

As an alternative method of incorporating the photochromic compound, a film which is substantially transparent to uv and visible light at the wavelengths that activate the photochromic compound, may be 'dyed' with a solution of the photochromic compound Any of the above-mentioned film-forming materials may be used to form the film, although this dyeing method is particularly suitable for materials into which the photochromic compound cannot be readily incorporated because, for example, it is insoluble in the spinning solvent or the spinning temperature would damage the compound. Examples of such materials are certain polyesters and regenerated cellulosics. This photochromic dyeing can be achieved by immersing the film in a dye bath containing the photochromic compound dissolved in a solvent which is a non-solvent for the film. The rate of dye uptake can, in general, be increased by increasing the temperature of the dye bath, especially by increasing it to a temperature above the glass transition point (but below the melting point) of the film. In addition the rate may be increased by including in the dye bath a plasticiser which swells the film.

Instead of, or in addition to, incorporating the photochromic compound into a self-supporting film, the photochromic layer may be applied as a coating on a substrate. The coating may comprise purely photochromic compound, or may comprise a photochromic compound mixed with a thermoplastic or thermosetting polymer which is applied as a powder coating.

The photochromic compound is preferably degraded by a uv laser. If a film containing a photochromic fulgide is irradiated by a uv laser the colour induced by uv irradiation appears immediately and generally reaches maximum intensity within 1 to 5 seconds for an unfocused uv laser of power 80 milliwatts. The time required to degrade the photochromic compound is generally at least 10 seconds, for example 30 seconds, for an unfocused uv laser but is substantially less, for example about 0.001 to 0.02 second, for a focused uv laser. Such a focused uv laser can be tracked to form a pattern of dots or a line. The uv laser preferably operates in the wavelength range 250–400 nm.

Examples of suitable uv lasers include an argon ion laser which operates at 351 to 364 nm and an 'excimer' (excited dimer) laser which generally operates at 248 to 351 nm. An argon ion laser has a relatively small beam width and so is especially suitable for writing an image onto the photochromic layer by scanning the laser beam across the layer according to a predetermined pattern and/or alternatively by moving the photochromic layer relative to the stationary laser beam. An excimer laser has a relatively wider beam width and so is especially suitable for forming an image in the photochromic layer by irradiating the layer through a mask. A defocused argon ion laser is also suitable for irradiation through a mask.

Alternatively the photochromic compound can be degraded in a desired pattern by prolonged exposure to light from a uv lamp through a mask. When a film containing a photochromic fulgide is irradiated by a uv lamp, for example a 100–125 watt medium pressure mercury arc lamp, the colour characteristic of uv irradiation is generally apparent in a second or two and typically reaches maximum intensity in 60 to 100 seconds. Irradiation with such a lamp can degrade sufficient of the photochromic compound to a permanently colourless form to give an image in 15 to 20 minutes. Shorter colouration and degradation times can be achieved with a more powerful uv lamp.

The layer of film-forming material can be formed as a self supporting film, for example a solvent cast film, which can for example be made up into a label. Adhesive can be applied to the film and this adhesive can be covered with a release sheet. The photochromic layer may be laminated with one or more other layers Thus a marker according to the invention may comprise a laminate of two or more films, at least one film containing a photochromic compound. For particularly complex, and therefore more secure images, the marker may comprise two or more films laminated together, each film containing a different photochromic compound.

The marker according to the invention is particularly useful for security applications. A label made from the layer of film-forming material and containing an image formed by degradation of the photochromic compound can be attached to an article such as goods, packaging or documents. The film-forming material can alternatively be applied as a coating on an article and subsequently exposed to degrade the photochromic compound. Alternatively a film can be used as an identification card or ticket or the film-forming material can be coated on or laminated to a substrate for such a card or ticket, for example of plastics or paper board.

A security marking according to the invention has the advantage that the presence of an image cannot be readily detected unless the marking, e.g. label or card, is examined under uv; there is no raised pattern on the surface of the film or coating. Moreover, where the photochromic compound is incorporated in a layer of film-forming material, a forger wishing to counterfeit the security marking needs to acquire film containing the photochromic compound and also apparatus capable of degrading the photochromic compound in a selected pattern. In this respect image formation by uv laser has a particular advantage. Application of a uv laser forms a region of intense uv light which degrades the photochromic compound in a selected pattern. This region is surrounded by a penumbra of less intense uv radiation. When the uv laser is applied to the photochromic layer a pattern is formed having the colour characteristic of the uv irradiated photochromic compound. This pattern rapidly becomes colourless due to degradation of the photochromic compound but the penumbra around the pattern, which has been less intensely uv irradiated, becomes coloured. The layer in this case should then be exposed to white light to convert all the non-degraded photochromic compound to its pale or colourless form characteristic of irradiation by white light. When the security marking is subsequently viewed under uv light the colourless image formed by the degraded photochromic compound is surrounded by a penumbra in which the colour generated by the photochromic compound is paler compared to the background areas of the film because the photochromic compound has been partially degraded in the penumbra. This penumbra is particularly characteristic of direct irradiation by a uv laser, although it may also be obtained by irradiation with uv light through a mask provided that the mask is not in direct contact with the photochromic layer, so that there is some distance between the mask and the layer.

When certain fulgides are used as the photochromic compound an even more distinctive image is obtained. The fulgides of formula (I) where $R^2$ is an aromatic group and $R^1$ a non-aromatic group are geometrical isomers of the fulgides where $R^1$ is an aromatic group and $R^2$ is a non-aromatic group. Only the fulgide where $R^2$ is aromatic is directly photochromic. The geometrical isomers are however capable of isomerisation in both directions under uv light. The fulgides of formula (I) are often most readily prepared as mixtures of the geometrical isomers. The directly photochromic isomer in which $R^2$ is aromatic can be separated, for example by crystallisation techniques, if desired. There can however be advantages in the use of a mixture of the isomers The radiation-induced reactions may be summarised by the scheme

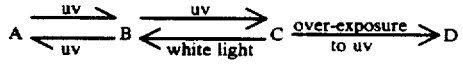

where A is the fulgide of formula (I) where $R^1$ is aromatic and $R^2$ is not; B is the fulgide of formula (I) where $R^2$ is aromatic and $R^1$ is not; C is the more highly coloured ring-closed photochromic compound; and D is the non-photochromic product of over exposure to uv. When a mixture of A and B is exposed to uv, isomerisation of A to B and B to A occurs; however the equilibrium of this reaction is affected by the photochromic cyclisation of B to C which is not reversible under uv (although it can be subsequently reversed by white light). Prolonged exposure to uv thus converts substantially the whole of the isomeric mixture of A and B to C before it is degraded to the non-photochromic form D. The image produced by a uv laser on a film containing a mixture of fulgide isomers A and B thus has a central position where the fulgide is wholly degraded to the non-photochromic form D; a penumbra in which the fulgide is partly degraded and a surrounding portion in which most or substantially all of the mixture of fulgide isomers has been converted to the coloured form C. When the film is exposed to white light after image formation all the coloured form C is converted to B, the less coloured form of the photochromic fulgide, rather than to A. When the film is subsequently examined under uv light the said surrounding area is seen as more highly coloured than the background since most or all of the fulgide in the said area is in the form of the photochromic isomer B while the background area has the original distribution of isomers A and B. This 'halo' of dark colour surrounding an image where the photochromic compound has been degraded to a non-photochromic form which is relatively colourless compared to the background provides a highly distinctive marking.

Thus in another embodiment the invention provides a marking comprising a photochromic layer which contains or consists of a mixture of a directly photochromic compound and a geometrical isomer of the photochromic compound, the isomers being reversibly isomerised to one another by uv light but being isomerised in neither direction by white light, the layer having an image formed therein by conversion of the mixture of isomers, either solely to the directly photochromic isomer or to a mixture having a substantially higher proportion of the directly photochromic isomer, by exposure of the layer to uv light in one or more selected areas.

The mixture of isomers contained in the layer in this case preferably comprises 0.5–80%, more preferably 2 to 10%, of the directly photochromic isomer. The ratio of directly photochromic isomer to the other isomer is preferably at least twice as much in the image areas as in the unimaged areas. When the film is subsequently examined under uv light, the whole film acquires the uv induced colour of the photochromic compound but the image areas have a darker and more intense colour.

The accompanying drawing shows an image produced in a marking according to the invention by overexposure to a uv laser of film containing a mixture of a directly photochromic fulgide and its geometrical isomer. It is described in Example 1 below.

The invention is further illustrated by the following Examples in which parts and percentages are by weight unless otherwise specified.

EXAMPLE 1

A plasticised cellulose diacetate film of average thickness 29.2 microns (μm) and containing a uniform dispersion of 1% of the fulgide alpha-2,5-dimethyl-3-thienylethylidene (isopropylidene) succinic anhydride (a mixture of 7% of the photochromic isomer where the 2,5-dimethyl-3-thienyl group is $R^2$ in (I) and 93% of the geometrical isomer where $R^2$ is methyl) was formed from a dope (cellulose diacetate 4.95 parts, diethyl phthalate plasticiser 1 part, the fulgide 0.06 part, acetone 34 parts) dry cast onto a smooth glass surface.

A piece of the film was mounted on a vertical wooden surface perpendicular to an incident laser beam. The laser emitted radiation at a wavelength of 351.1–363.8 nm in the ultra-violet region of the spectrum with a beam diameter of ca 1.25 mm. Exposure of the target film to a continuous power of 80 mW was controlled by a manual shutter.

As seen by eye, colouration of the film at the point of incidence of the laser beam was instantaneous. The magenta-coloured spot increased in intensity during irradiation for a period of 4 seconds. Thereafter further exposure of the same point to the laser beam induced a reduction in colour intensity at the centre of the spot until, after 19 seconds exposure, the central region appeared completely colourless and surrounded by a magenta halo.

The film was then removed from the wooden support and the whole exposed for 17 seconds to light emitted from a 375 W photoflood lamp (Phillips PF 215) transmitted through a 3 mm thick, 420 nm cut-off filter (Schott glass GG420). The magenta halo became colourless as the coloured photochromic was returned to its non-coloured form.

Subsequent irradiation by uv light emitted by a 125W mercury arc lamp (Phillips HPR125W) and transmitted through a 3 mm thick, 300–400 nm bandpass filter (Schott glass UG 1) caused a general colouration of the photochromic film except for a circular region (ca 0.75 mm diameter) where the laser beam had been incident.

The image is represented diagrammatically in the accompanying FIG. 1. A colourless spot 1 was clearly observed as a result of photodegradation of the coloured form of the photochromic fulgide in that region of the film. This colourless spot 1 was surrounded by a penumbra 2 of increasing colour, and outside that a ring 3 having a more intense purple colour than the background 4. In this ring 3 the fulgide had largely been converted to its photochromic isomer ($R^2$=2,5-dimethyl-3-thienyl) but had not been degraded.

EXAMPLE 2

The procedure of Example 1 was followed using as the fulgide alpha-2,5-dimethyl-3-furylethylidene (isopropylidene) succinic anhydride ( a mixture of 67% of the photochromic isomer where the 2,5-dimethyl-3-furyl group is $R^2$ in (I) and 33% of the geometrical isomer where $R^2$ is methyl). The image obtained after uv laser exposure, followed by treatment with white light and subsequent examination under uv light, was the same as in Example 1 except that the coloured background of the film was red rather than purple and the ring of darker colour was somewhat less intense than in Example 1.

EXAMPLES 3–10

The following Examples illustrate the wide variety of film-forming materials that can be made up into dopes containing photochromic compound and cast into films which can be used to form a marker according to the invention. In each example, unless otherwise specified, the film contained ca 1% of the fulgide defined in Example 1 above. In each example a sample of the film, ca 5×5 $cm^2$, was over-exposed to a uv laser to form an image in the film. An argon ion laser tuned to operate at a wavelength of 351.1–363.8 nm was used together with a quartz plano-convex lens of focal length 100 mm to bring the laser beam to a focus in the plane of the film. The unfocused diameter of the laser beam was 1.25 mm. The film was positioned, orthogonal to the laser beam, on a rotatable support. During exposure to the uv laser, the film was rotated at ca 200 r.p.m whilst maintaining the laser beam in a stationary position, so that a circular image was inscribed into the film. The laser was operated at a power of 110 mW and the film exposed for a total time of 37 seconds unless otherwise specified. The total energy density of incident radiation during exposure (hereafter 'energy density') and the energy delivered per revolution per beam width (hereafter 'pulse energy') was varied in each case, by altering the distance between the laser beam and the centre of rotation of the sample, i.e. altering the radius of the circular image.

After laser irradiation the film was exposed to visible radiation from a 350W photoflood lamp (Phillips PF 215E/49) to remove all peripheral colouration around the image. The film was subsequently irradiated with uv light from a 125W mercury arc lamp (Phillips HPR125W) to colour the film and reveal the colourless image.

EXAMPLE 3

A plasticised cellulose diacetate film containing a uniform dispersion of 1% fulgide was solvent-cast from a dope consisting of 12.65% cellulose diacetate, 2.28% diethylphthalate, 0.15% fulgide and 84.92% acetone. The dope was cast onto a smooth glass surface and dried at 60° C. for 10 minutes, and then removed from the glass. The resulting film had an average thickness of 50 μm.

A circular image was inscribed into the near colourless film by over-exposure to a uv laser as described above. The energy density used was 2.23 J/mm² and the pulse energy 38.6 μJ. After subsequent irradiation by visible light followed by uv light a near-colourless image was seen on a magenta background.

EXAMPLE 4

A cellulose diacetate film was cast as described in Example 3 except that 0.367% of the pigment Orasol Yellow 4GN and 0.013% of the pigment Orasol Orange RLN, both available from Ciba-Geigy, the percentages being based on the total weight of solids, were added to the dope to produce a yellow film, and the resulting film had an average thickness of 180 μm.

A circular image was inscribed with the film as described above using an energy density of 0.53 J/mm² and a pulse energy of 38.4 μJ. When subsequently viewed after irradiation with a uv lamp a yellow image was seen on a browny-purple background.

EXAMPLE 5

A cellulose diacetate film was cast as described in Example 3 except that 0.75%, based on the weight of the solids, of lead carbonate pigment was added to the dope to produce a dull, semi-opaque, i.e. 'pearlised', film.

A circular image was inscribed into the film as described above using an energy density of 0.86 J/mm² and a pulse energy of 62.7 μJ. When subsequently viewed after irradiation with uv light a pearly-white image was seen on a magenta background.

EXAMPLE 6

A polyurethane film was cast from a dope consisting of 12.0% of the polyurethane Desmopan 385—available from Bayer, 0.12% fulgide and 87.88% THF. The dope was cast onto a glass surface and dried at room temperature for 1 hour. The resulting film had an average thickness of 75 μm and contained a uniform dispersion of 1% of the fulgide. The film was transparent with a faint yellow tinge.

A circular image was inscribed into the film as described above using an energy density of 1.2 J/mm² and a pulse energy of 89.1 μJ. When subsequently viewed after irradiation with uv light a near-colourless image was seen on a magenta background.

EXAMPLE 7

A plasticised polyvinylchloride-polyvinylacetate copolymer film containing a uniform dispersion of 1% fulgide was cast from a dope consisting of 17.71% of the polyvinylchloride-polyvinylacetate copolymer Vilit AS47—available from Huls UK, 5.32% of the plasticiser Palamoll 656—available from BASF, 0.23% of the fulgide and 76.74% acetone. The film was cast onto release paper and dried at 60° C. for 10 minutes. The resulting film had an average thickness of 85 μm and was colourless.

A circular image was inscribed into the film as described above using an energy density of 0.80J/mm² and a pulse energy of 27.7 μJ. When subsequently viewed after irradiation with uv light a colourless image was seen on a magenta background.

EXAMPLE 8

A polycarbonate film containing a uniform dispersion of 0.8% fulgide was cast from a dope consisting of 10.26% of the polycarbonate Lexan ML9735—available from General Electric Plastics, 0.09% fulgide and 89.65% methylene chloride. A drop of methanol was added to the dope to aid mixing. The dope was cast to give a colourless film, with an average thickness of 65 μm.

A circular image was inscribed into the film as described above using an energy density of 1.65 J/mm² and a pulse energy of 119 μJ. When subsequently viewed after irradiation with uv light a colourless image was seen on a magenta background.

EXAMPLE 9

A polyvinylchloride-polyvinylalcohol copolymer film was cast from a dope consisting of 23.0% of the polyvinylchloride-polyvinyl alcohol copolymer Vinnol H40/60—available from Wacker-Chemie, 0.36% fulgide and 76.64% acetone. The dope was cast onto release paper to give a colourless film.

A circular image was inscribed into the film as described above using an energy density of 1.41 J/mm², a pulse energy of 43.9 μJ and an exposure time of 87 seconds. When subsequently viewed after being irradiated with uv light a colourless image was seen on a magenta background.

EXAMPLE 10

A polymethylmethacrylate film was cast from a dope consisting of 26.63% of the polymethylmethacrylate Diakon MG—101 available from I.C.I., 10.65% of diethylphthalate, 0.59% fulgide and 62.13% acetone. The dope was cast onto a glass surface and dried for 10 minutes at 60° C. to produce a colourless film having an average thickness of 134 μm.

A circular image was inscribed into the film as described above using an energy density of 1.82 J/mm², a pulse energy of 52.6 μJ and an exposure time of 93 seconds When subsequently viewed after irradiation with uv light a near-colourless image was seen on a magenta background.

EXAMPLE 11

Most commercially available polyesters are not soluble in solvents for the photochromic compounds. Therefore a photochromic compound was incorporated into polyester film using a 'dyeing' technique.

A small piece of polyester film Melinex S—available from I.C.I. and having an average thickness of 175 μm—was immersed in a dye bath consisting of 98.28% xylene solvent, 1.18% of the dye carrier 2-methylnaphthalene and 0.54% of the fulgide of Example 1. The dye bath was refluxed for 5 hours, after which the film was removed, washed in xylene and dried at 50° C. for 10 minutes An image was formed in the film by over-exposing a selected area to uv light from an argon ion laser as described in Examples 3 to 10. When subsequently viewed after irradiation with uv light the image was seen as colourless on a magenta background of medium colour intensity.

EXAMPLE 12

A small piece of cellulose diacetate film Clarifoil—available from Courtaulds Fibres Ltd—having an average thickness of 50 μm was immersed in a dye bath consisting of 94.34% toluene, 0.94% of the fulgide of Example 1 and 4.72% diethylphthalate. The diethylphthalate acts as both a swelling agent for the film and a dye carrier. The dye bath was refluxed for 3 hours after which the film was removed and dried.

An image was formed in the film as described in Examples 3 to 10. The image, when viewed after irradiation with uv light, was colourless on a magenta background.

EXAMPLE 13

500 parts of Shell K543 polypropylene—polyethylene copolymer moulding powder-available from Shell—was mixed with 5 parts of the fulgide of Example 1. The powders were mixed by shaking followed by mixing in a small-scale melt extruder. The melt was extruded at 170° C. through orifices to form strands which were dried and chopped to give a secondary moulding powder. The powder had a very pale pink colouration.

The secondary moulding powder was then melt extruded at 180° C. through a 20 cm wide slit die to form a film of 30 μm average thickness. The film was transparent and had a pink colouration. (It is thought that the pink colour was probably due to some thermal colouration degradation of the fulgide.)

A selected area of the film was irradiated with uv light using a UGI-filtered mercury arc lamp which operated at a wavelength of 300–400 nm, with maximum transmission at 360 nm. The area was irradiated for 12 minutes to over-expose it to the uv light and degrade the photochromic fulgide. When subsequently irradiated with uv light a colourless image could just be detected with the naked eye against a weakly coloured pink background. To increase the colour difference between the image and the background more photochromic compound could be incorporated into the polymer melt prior to extrusion.

EXAMPLE 14

A cellulose diacetate film was produced as described in Example 3. An image was formed in the film using an 308 nm (XeCl) excimer laser tuned to operate as follows:

| | | |
|---|---|---|
| Pulse frequency | 50 Hz | |
| Pulse energy | 0.035 J/cm$^2$ | |
| Irradiation time | 20 seconds | (= 1,000 pulses) |

The film was exposed to the laser through a mask. The mask consisted of a metallic strip from which the numerals 1 and 2 had been punched out. Each numeral measured approximately 1.8 mm long and 1.3 mm wide at its widest point. The laser beam was passed through the mask and focused onto the film. After irradiation for the above-mentioned time colourless images of the numerals 1 and 2 were seen surrounded by a coloured penumbra The film was exposed to white light from a projecter beam for 20 seconds to convert the coloured penumbra to colourless and thus give an invisible image. After subsequent irradiation with uv light from a 125W mercury arc lamp (Phillips HPR 125W) the numerals 1 and 2 appeared colourless against a magenta background.

EXAMPLE 15

Example 14 was repeated except that a 351 nm (XeF) excimer laser was used instead of the XeCl laser. The XeF laser was tuned to operate as follows:

| | | |
|---|---|---|
| Pulse frequency | 200 Hz | |
| Pulse energy | 0.014 J/cm$^2$ | |
| Irradiation time | 20 seconds | (= 4,000 pulses) |

Imaging was carried out as described in Example 14 except that the numerals in the mask were 0 and 1. After subsequent irradiation with uv light these numerals appeared as colourless images on a magenta background.

EXAMPLE 16

A cellulose diacetate film of average thickness 52μm was produced as described in Example 3 except that the fulgide was replaced with a dihydroxanthenone of the formula:

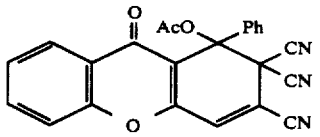

A method for the preparation of this compound is given in a paper entitled 'New Photochromic Cyclohexadienes' by K. R. Huffman et al, J. Org. Chem., Vol. 34, No. 8 (1969), pp. 2407–2414. The resulting film was transparent with a yellow tinge.

A circular image was inscribed into the film using an argon ion laser (351.1, 363.8 nm) at a power of 96.8 mW. The film was exposed for 45 seconds using an energy density of 0.28 J/mm$^2$ and a pulse energy of 41.1 μJ after which time a colourless circle with a purply-coloured rim could be seen. The film was placed in a cabinet for 2 hours at 61° C. after which time the purply-coloured rim had substantially disappeared due to the thermal instability of the dihydroxanthenone in its coloured state The film was subsequently irradiated for 15 seconds with a uv lamp (Phillips HPR 125W) through a UG1 filter, after which a near-colourless circular image was seen on a purple background.

EXAMPLE 17

A cellulose diacetate film of average thickness 52 μm was produced as described in Example 3 except that the fulgide was replaced with a spirobenzopyran—available from Kodak—of the formula:

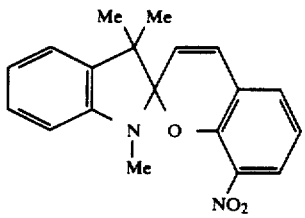

The film was imaged as described in Example 16 except that the exposure time was 15 seconds, the energy density 0.12 J/mm$^2$ and the pulse energy 21.7 $\mu$J. A yellow/brown circular image was formed which could not be bleached with white light. After subsequent irradiation with uv light this yellow/brown image was seen against a deep mauve background. This mauve colour faded with time due to the thermal instability of the spirobenzopyran in its coloured state.

EXAMPLE 18

A cellulose diacetate film of average thickness 60 $\mu$m was produced as described in Example 3 except that the fulgide was replaced with a chromone of the formula:

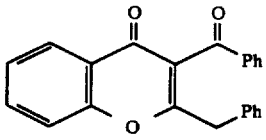

A method for the preparation of the chromone is given in J. Am. Chem. Soc., Vol. 87, No. 23 (1965), pp 5417–5423.

A circular image was inscribed in the film by exposing the film to an argon ion laser operating at a power of 49.8 mW for 15 seconds The energy density used was 0.50 J/mm$^2$ and the pulse energy 27.0 $\mu$J. The image formed was yellow against a colourless background. After subsequent irradiation with uv light the yellow image remained against a yellow-orange background.

We claim:

1. An image-bearing film comprising a film-forming material having incorporated therein a reversibly photochromic compound which is capable of converting from pale or colourless to coloured under uv light and of reverting to pale or colourless, said film having an image formed therein by complete or partial conversion of the photochromic compound to a permanently non-photochromic compound in one or more selected areas, which non-photochromic compound cannot readily be distinguished by the eye against a background of the pale or colourless form of the photochromic compound but is readily distinguished against a background of the coloured form of the photochromic compound.

2. The image-bearing film according to claim 1 wherein the film forming material is cellulose acetate.

3. The image-bearing film according to claim 1 wherein the photochromic compound is capable of converting from pale or colourless to coloured under uv light and of reverting to pale or colourless under visible light.

4. The image-bearing film according to claim 1 wherein the photochromic compound is capable of converting from pale or colourless to coloured under uv light and of thermally reverting to pale or colourless.

5. The image-bearing film according to claim 1 wherein the photochromic compound is a fulgide, fulgimide or N-aminofulgimide.

6. The image-bearing film according to any of claims 1, 2, 3, 4 or 5 wherein the photochromic compound has been converted to a permanently non-photochromic compound by over-exposure of the layer to uv light in one or more selected areas.

7. The image-bearing film according to claim 6 wherein the uv light is derived from a uv laser.

8. The image-bearing film according to claim 1, in which the image after radiation with uv light comprises a colourless area surrounded by a penumbra in which the colour is paler compared to the background colour of the layer.

9. A label comprising the image-bearing film according to claim 1 coated with a layer of adhesive and optionally having a release sheet attached to the adhesive.

10. A coated article in which the coating film is an image-bearing film according to claim 1.

11. An image-bearing film comprising a film-forming material having incorporated therein a mixture of a directly photochromic compound and a geometrical isomer of the photochromic compound, the isomers being reversably isomerized to one another by uv light but being isomerized in neither direction by white light, the layer having an image formed therein by conversion of the mixture of isomers, either to solely the directly photochromic isomer or to a mixture having a substantially higher proportion of the directly photochromic isomer, by exposure of the layer to uv light in one or more selected areas.

12. A method of forming an image in a film comprising a film-forming material having incorporated therein a reversibly photochromic compound which is capable of converting from pale or colourless to coloured under uv light and of reverting to pale or colourless, comprising converting at least part of the photochromic compound to a permanently non-photochromic compound in one or more selected areas, which non-photochromic compound cannot readily be distinguished by the eye against a background of the pale or colourless form of the photochromic compound but is readily distinguished against a background of the more coloured form of the photochromic compound.

13. A method according to claim 12 wherein the photochromic compound is over-exposed to uv light to effect the conversion to the permanently non-photochromic compound.

* * * * *